US012043970B2

(12) United States Patent
Yamazaki

(10) Patent No.: US 12,043,970 B2
(45) Date of Patent: Jul. 23, 2024

(54) SNOW REMOVAL MACHINE

(71) Applicant: HONDA MOTOR CO., LTD., Tokyo (JP)

(72) Inventor: Nobuo Yamazaki, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 437 days.

(21) Appl. No.: 17/255,382

(22) PCT Filed: Jul. 2, 2018

(86) PCT No.: PCT/JP2018/025048
§ 371 (c)(1),
(2) Date: Dec. 22, 2020

(87) PCT Pub. No.: WO2020/008494
PCT Pub. Date: Jan. 9, 2020

(65) Prior Publication Data
US 2021/0262184 A1 Aug. 26, 2021

(51) Int. Cl.
*E01H 5/09* (2006.01)

(52) U.S. Cl.
CPC ..... *E01H 5/098* (2013.01); *E01H 5/09* (2013.01)

(58) Field of Classification Search
CPC ..... E01H 5/098; E01H 5/09; E01H 5/045; E01H 5/04; E01H 5/07; E01H 5/076; E01H 5/08
(Continued)

(56) References Cited

U.S. PATENT DOCUMENTS 6,327,798 B1 * 12/2001 Sakai ..... E01H 5/04 37/249
7,121,021 B2 * 10/2006 Sakai ..... E01H 5/045 37/259
(Continued)

FOREIGN PATENT DOCUMENTS

JP 47-17550 6/1972
JP 4717550 Y1 * 6/1972
(Continued)

OTHER PUBLICATIONS

International Preliminary Report on Patentability dated Jan. 14, 2021, 9 pages.
(Continued)

*Primary Examiner* — Thomas B Will
*Assistant Examiner* — Audrey L Lusk
(74) *Attorney, Agent, or Firm* — Rankin, Hill & Clark LLP

(57) ABSTRACT

A snow removal machine is provided which may prevent ejection of snow collected by a snow-collecting unit to an outside and may perform efficient snow removal. A snow removal machine includes a driving source, an auger housing, a rotating shaft to be driven and rotated by the driving source within the auger housing, and an auger arranged within the auger housing and to be driven and rotated via the rotating shaft, the auger includes snow-collecting blades located on both sides in a width direction of the auger and collecting snow toward a center of the auger in the width direction and a snow-throwing blade located at the center of the auger in the width direction, casting snow collected by the snow-collecting blades by a centrifugal force, and discharging snow to an outside via a chute, and the snow-collecting. blades are rotated at a lower speed than the snow-throwing blade.

9 Claims, 4 Drawing Sheets

(58) Field of Classification Search
USPC ..... 37/251
See application file for complete search history.

(56) References Cited

U.S. PATENT DOCUMENTS

| | | | | |
|---|---|---|---|---|
| 2009/0173600 | A1* | 7/2009 | Niederer | E01H 5/045 198/642 |
| 2015/0033590 | A1* | 2/2015 | Kanbara | E01H 5/098 37/250 |

FOREIGN PATENT DOCUMENTS

| | | | | |
|---|---|---|---|---|
| JP | H03-241108 | | 10/1991 | |
| JP | 2001-049634 | | 2/2001 | |
| WO | 2010/095234 | | 8/2010 | |
| WO | WO-2010095234 | A1 * | 8/2010 | E01H 5/045 |

OTHER PUBLICATIONS

International Search Report, Date of mailing: Sep. 18, 2018, 2 pages.
Written Opinion of the International Searching Authority dated Sep. 18, 2018, 4 pages.

* cited by examiner

SNOW REMOVAL MACHINE

TECHNICAL FIELD

The present invention relates to a snow removal machine and to a snow removal machine that prevents ejection of snow collected by a snow-collecting unit to an outside and enables efficient snow removal to be achieved.

BACKGROUND ART

In related art, for example, a technique has been disclosed in which an auger shaft with a small diameter is caused to pass through a hollow blower shaft, an auger pulley is fixed to one end of this auger shaft, the other end is extended to a gear casing, an auger is driven by the auger shaft via the gear casing, a blower pulley and the auger pulley are adjacently positioned, a blower driving belt wound on the blower pulley is wrapped around a prime-mover-side pulley, an auger driving belt is also wrapped around this prime-mover-side pulley, and this auger driving belt is wound on the auger pulley (for example, see Patent Literature 1) .

CITATION LIST

Patent Literature

[Patent Literature 1]
Japanese Patent Laid-Open No. 2001-049634

SUMMARY OF INVENTION

Technical Problem

However, in a technique in the Cited Literature 1, a driving mechanism is necessary for each of a blower and an auger, thus resulting in a complicated structure and a high manufacturing cost.

Here, in a case of a so-called single stage type in which the auger is used for both snow collection and snow throwing, snow-collecting units and a snow-throwing unit are similarly driven and rotated at high speeds.

In general, a snow removal machine does not necessarily use a whole auger width for performing snow removal but may perform snow removal by using approximately half a region of the auger width, for example.

Thus, in a case where approximately half the auger width is set as a snow removal width, the snow collected by the snow-collecting unit is sent toward the opposite side at a high speed, the snow is ejected to an outside of the snow removal machine, and snow may not properly be handled.

Meanwhile, in a case where snow removal is performed by using the whole width of the auger width, parts of snow casted toward a center from left and right snow-collecting units collide with each other, and the amount of snow ejected to the outside of the snow removal machine may thus be reduced; however, it is difficult to perform work by always setting the whole width of the auger width as the snow removal width.

Further, there is also a problem that loss of horsepower of a driving source is large because the snow collecting units rotate at a high speed to stir snow.

An object of the present invention, which has been made in consideration of the above-described point, is to provide a snow removal machine that may prevent ejection of snow collected by a snow-collecting unit to an outside and may perform efficient snow removal.

Solution to Problem

To achieve the above object, an aspect of the present invention provides a snow removal machine including: a driving source; an auger housing; a rotating shaft to be driven and rotated by the driving source within the auger housing; and an auger arranged within the auger housing and to be driven and rotated via the rotating shaft, in which the auger includes: snow-collecting units located on both sides in a width direction of the auger, the snow-collecting units each collecting snow toward a center of the auger in the width direction; and a snow-throwing unit located at the center of the auger in the width direction, the snow-throwing unit casting snow collected by the snow-collecting units by a centrifugal force and discharging snow to an outside via a chuter, and in which the snow-collecting units are rotated at a lower speed than the snow-throwing unit.

Accordingly, because the show-collecting units are rotated at a lower speed than the snow-throwing unit, when snow is collected by the snow-collecting units, in a case where snow removal is performed in a whole width of the auger or even in a case where snow removal is performed in approximately half a width of the auger housing, the speed of snow casted by the snow-collecting units is slow, and snow is thus not ejected to the outside of the auger housing.

In the above configuration, the snow-collecting units on the both sides are rotated in different phases.

Accordingly, vibration in a width direction occurs in a vehicle body frame when the two snow-collecting units rotate, as a result a tip end of the auger housing bites into snow, allowing smooth snow removal. Furthermore, because timings of snow collection by the snow-collecting units are shifted from each other, parts of snow collected by the snow-collecting units do not collide with each other, scattering of snow is prevented, and efficient snow removal may be achieved.

In the above configuration, the rotating shaft receives a driving force from the driving source and is coupled with the snow-throwing unit, and the rotating shaft includes a sub rotating shaft coupled with the snow-collecting units and a speed reduction mechanism reducing a speed of the driving force of the rotating shaft and transmitting the driving force to the sub rotating shaft.

Accordingly, because the rotating shaft and the sub rotating shaft may be driven and rotated by one driving source, energy saving and size reduction may be intended compared to a case where the snow-collecting units and the show-throwing unit are driven by separate driving sources.

In the above configuration, the sub rotating shaft is arranged outside and concentrically with the rotating shaft.

Accordingly, because the rotating shaft and the sub rotating shaft are concentrically arranged, space saving may be intended.

In the above configuration, the snow-collecting units and the snow-throwing unit rotate in mutually opposite directions.

Accordingly, because the snow-throwing unit and the snow-collecting units are driven and rotated in opposite directions, the snow-collecting units easily bite into show in collecting snow, and the reaction force lifting the vehicle body frame of the snow removal machine may thereby be suppressed. In particular, biting performance of the snow-collecting units into hard snow may be improved.

In the above configuration, the speed reduction mechanism includes a first speed reduction mechanism connected with the rotating shaft and a second speed reduction mechanism connected with the first speed reduction mechanism, and the second speed reduction mechanism is connected with the sub rotating shaft.

Accordingly, the first speed reduction mechanism and the second speed reduction mechanism are arranged between the rotating shaft and the sub rotating shaft, and the snow-throwing unit and the snow-collecting units may thereby be driven and rotated in opposite directions by a simple structure.

In the above configuration, a rotational speed ratio between the snow-throwing unit and the show-collecting units is approximately 10:1.

Accordingly, while snow collection by the snow-collecting units is performed at a low speed, the snow collected by the snow-collecting units may certainly be thrown by the snow-throwing unit.

Advantageous Effects of Invention

In an aspect of the present invention, because snow-collecting units are rotated at a lower speed than a snow-throwing unit, when snow is collected by the snow-collecting units, in a case where snow removal is performed in a whole width of an auger or even in a case where snow removal is performed in approximately half a width of an auger housing, the speed of snow casted by the snow-collecting units is slow, and snow is thus not ejected to an outside of the auger housing. As a result, snow may efficiently be collected by the snow-collecting units, and efficiency of snow removal work may be enhanced.

DESCRIPTION OF EMBODIMENTS

An embodiment of the present invention will hereinafter be described with reference to drawings.

Figure 1:
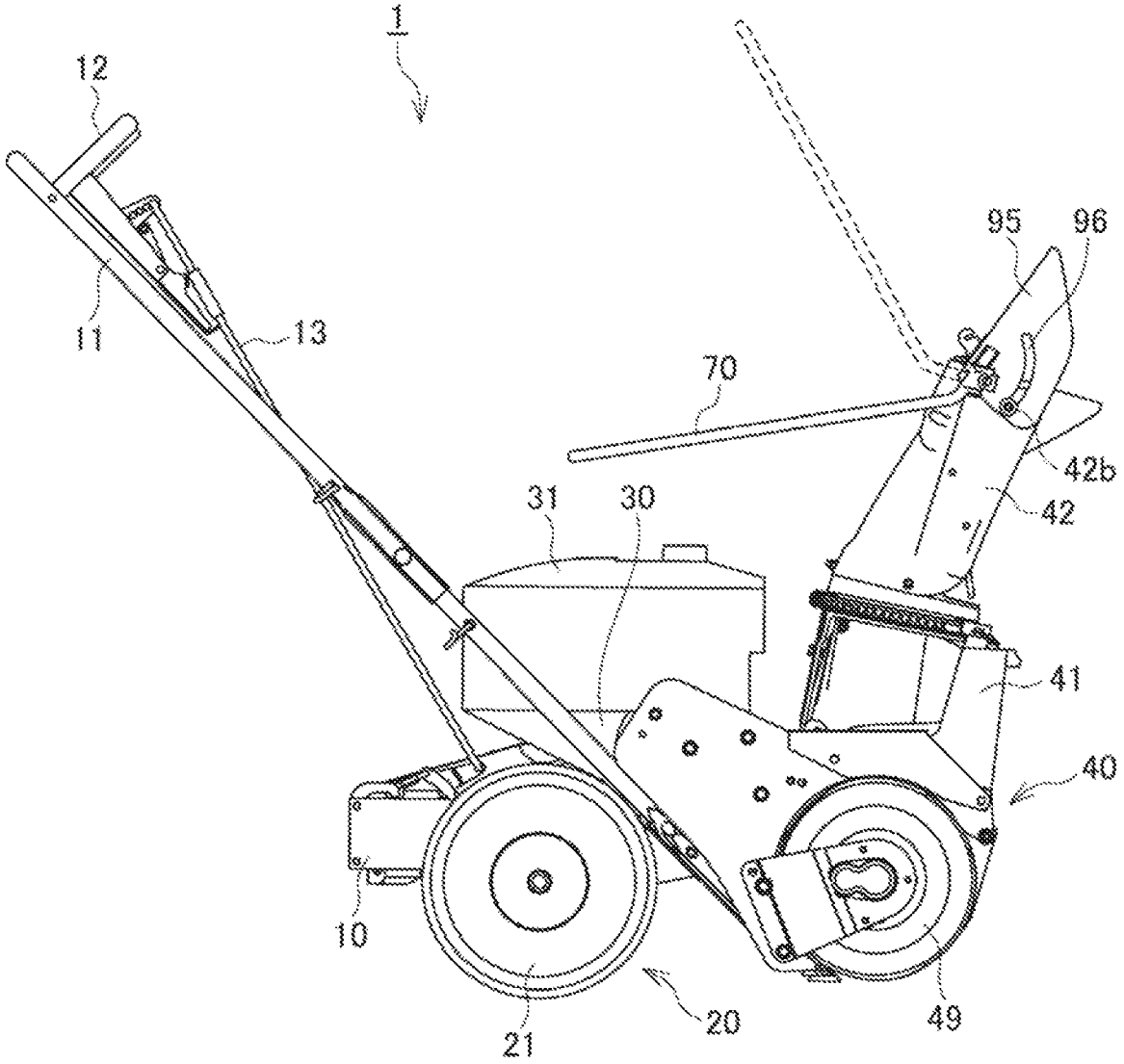
FIG. 1 is a front view illustrating an embodiment of a snow removal machine of the present invention.
Figure 2:
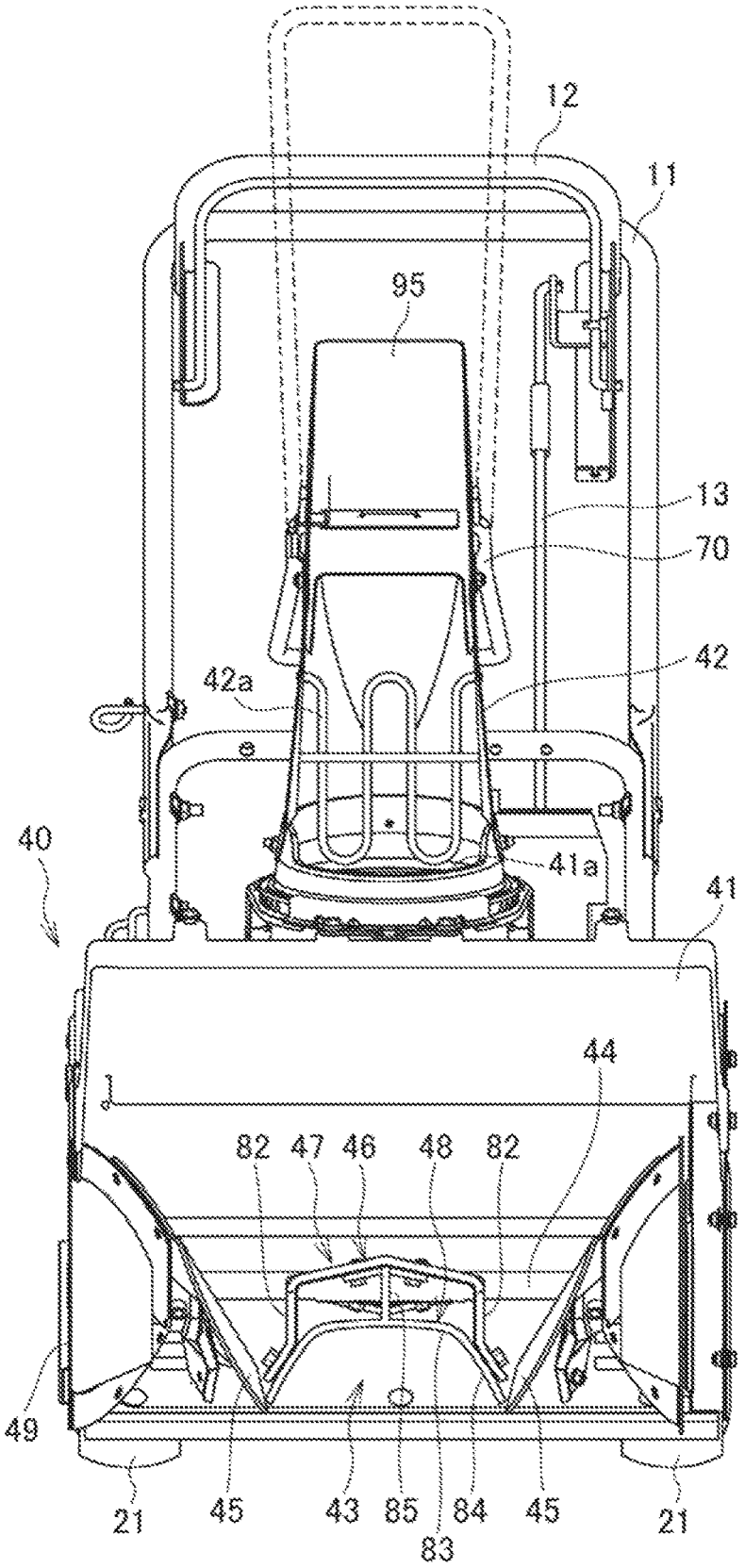
FIG. 2 is a side view illustrating the snow removal machine of this embodiment.
Figure 3:
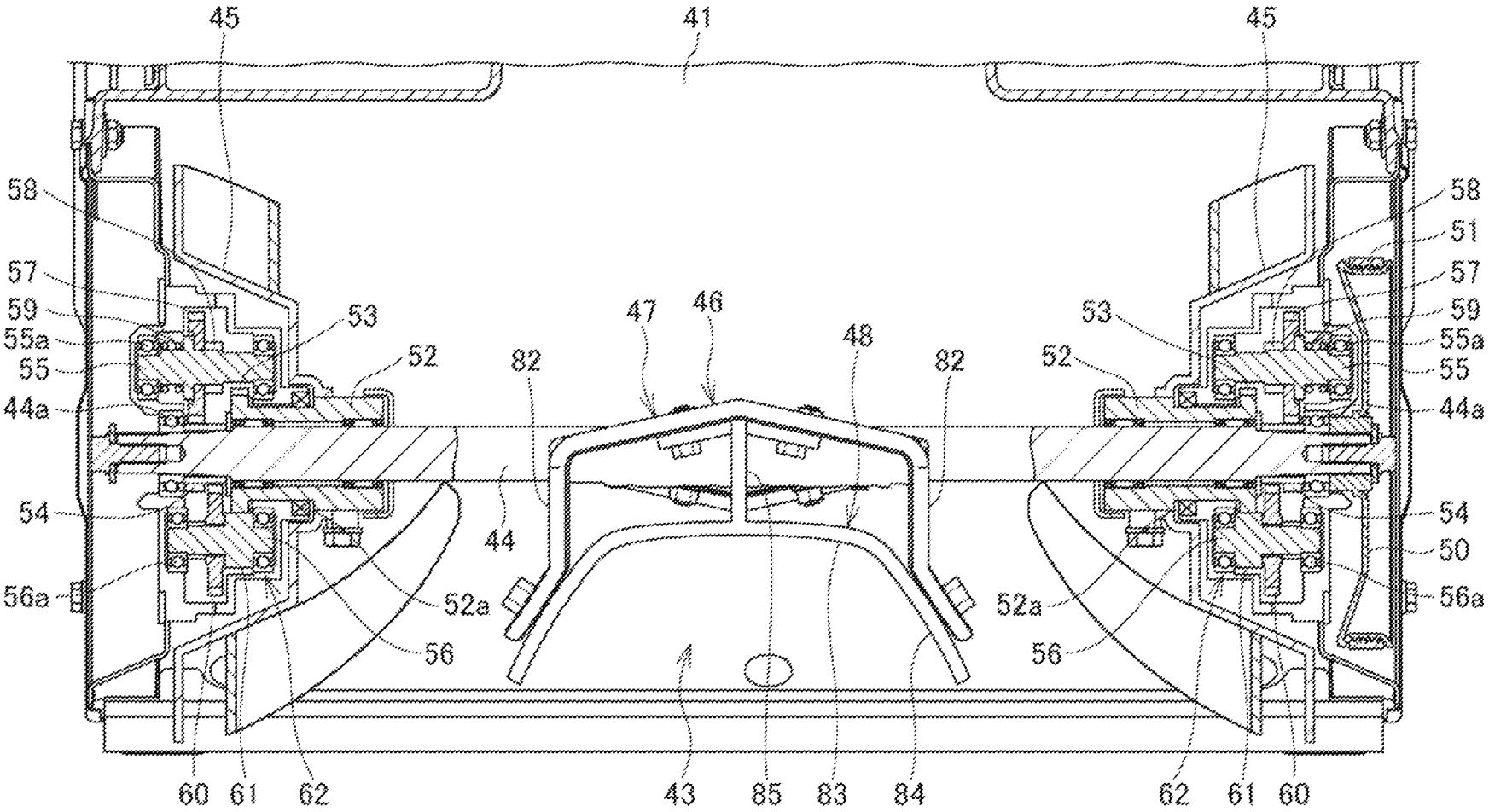
FIG. 3 is a configuration diagram illustrating an auger part of this embodiment.

FIG. 1 is a front view illustrating an embodiment of a snow removal machine according to the present invention. FIG. 2 is a side view illustrating the snow removal machine of this embodiment. FIG. 3 is a configuration diagram of an auger part.

As illustrated in FIG. 1 to FIG. 3, a show removal machine 1 includes a vehicle body frame 10, and the vehicle body frame 10 includes a traveling device 20, a driving source 30, and a snow removal work unit 40. In the rear of the vehicle body frame 10, a handle 11 extending toward a rear upper portion is provided. A worker may operate the snow removal machine 1 by the handle 11 while walking with the snow removal machine 1.

On a generally central part of the vehicle body frame 10, the driving source 30 including a fuel tank 31 is mounted. This driving source 30 drives the traveling device 20 and the snow removal work unit 40 and is configured with an engine, for example. Note that a gasoline engine is preferable for the driving source 30, but a diesel engine or an electric motor may be used.

The traveling device 20 includes driving wheels 21 arranged in lower rear portions of the vehicle body frame 10. The driving wheels are configured such that motive power from the driving source 30 is transmitted thereto via a motive power transmission mechanism and a clutch mechanism (neither illustrated). Accordingly, in this configuration, the driving source 30 is driven and the driving wheels 21 are thereby driven to move forward or driven to move rearward via the motive power transmission mechanism and the clutch mechanism.

An operation lever 12 is provided to a tip end portion of the handle 11. The operation lever 12 is formed into a general U-shape, and both end portions thereof are attached to insides of the handle 11. The operation lever 12 is attached swingably in a front-rear direction with respect to attachment positions to the handle 11 as centers.

One end of a coupling shaft 13 is coupled with the operation lever 12, the other end of the coupling shaft 13 is connected with a driving wheel part of the vehicle body frame 10, and in this configuration, the driving wheels may be driven or stopped by a swinging operation of the operation lever 12.

In front of the vehicle body frame 10, the snow removal work unit 40 is provided.

The snow removal work unit 40 includes an auger housing 41. The auger housing 41 extends in a width direction of the vehicle body frame 10 and is formed into a tubular shape whose front portion is open. A circular snow-throwing opening 41*a* is formed in an upper portion of the auger housing 41 and in a center of the auger housing in a width direction.

A tubular chuter 42 communicating with the inside of the auger housing 41 is attached to the snow-throwing opening 41*a* of the auger housing while being inclined with respect to the snow-throwing opening 41*a*. The chuter 42 extends upward and is made rotatable along a peripheral portion of the snow-throwing opening 41*a* such that a direction in which the removed snow is discharged may be adjusted. A guide 42*a* meandering in an up-down direction is provided within the chuter 42.

A chute 95 is attached to an upper end portion of the chuter 42 swingably in the up-down direction, the chute 95 being for adjusting an angle at which the removed snow is discharged. Arc-shaped guide holes 96 are formed on both sides of the chute 95, and guide pins 42*b* attached to both sides of the chuter 42 are engaged with the guide holes 96. Accordingly, in this configuration, the guide holes 96 are moved along the guide pins 42*b* and the chute 95 may thereby be swung up and down.

Further, a chuter operation handle 70 is attached to both sides of a lower portion of the chute 95. The chuter operation handle 70 is formed into a general U-shape and is configured such that a rotation operation of the chuter 42 and an up-down swinging operation of the chute 95 may be performed by operating the chuter operation handle 70.

An auger 43 is provided within the auger housing 41. The auger 43 includes a rotating shaft 44 extending in the width direction of the auger housing 41.

The auger 43 includes snow-collecting blades 45, which serves as snow-collecting units, located on both sides of the rotating shaft 44 for collecting snow toward the center of the auger 43 in the width direction, and a snow-throwing blade 46, which serves as a snow-throwing unit, located at a center of the rotating shaft 44 for casting show collected by the snow-collecting blades 45 by a centrifugal force and discharging snow to the outside via the chuter 42.

The snow-collecting blades 45 are attached to the rotating shaft 44 while being inclined at a prescribed angle with respect to that. The snow-throwing blade 46 is configured with a rotating plate 47 and a snow-throwing plate 48 arranged at a prescribed space on an outer circumferential side of this rotating plate.

Side disk augers 49 are provided on both sides of the auger housing 41.

Note that in this embodiment, the snow-collecting blades 45 are provided on both sides of the rotating shaft 44 in an axial direction but may be provided on only one side of the rotating shaft 44 in a width direction.

Next, a motive power transmission mechanism in the snow removal work unit 40 will be described in detail.

Figure 4:
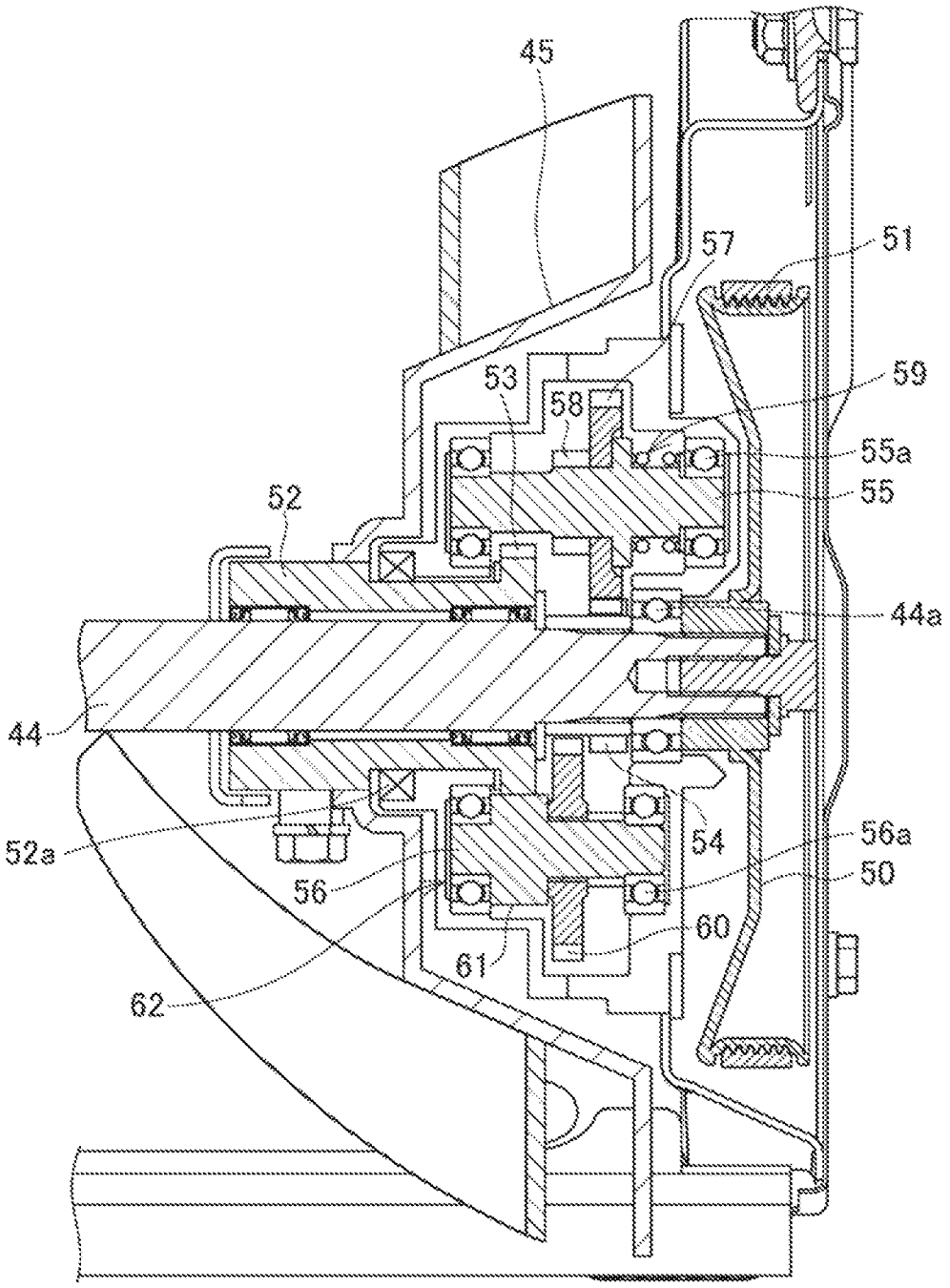
FIG. 4 is a cross-sectional view illustrating a motive power transmission mechanism of the auger part of this embodiment.

FIG. 4 is a cross-sectional view illustrating the motive power transmission mechanism of the snow removal work unit 40. Note that FIG. 4 illustrates only one end part of the rotating shaft 44.

As illustrated in FIG. 4, the rotating shaft 44 is rotatably supported by bearings 44*a* in both end portions of the auger housing.

A driving pulley 50 is attached to one end portion of the rotating shaft 44. A driving belt 51 rotated by the driving source 30 is wound around the driving pulley 50. Further, the driving pulley 50 is driven and rotated via the driving belt 51 by driving the driving source 30, and the rotating shaft 44 may thereby be driven and rotated.

On an outer circumferential side of the rotating shaft 44, a snow-collecting rotating shaft 52 is rotatably supported by a bearing 52*a*. The snow-collecting rotating shaft 52 is coaxially arranged with the rotating shaft 44 and is made rotatable separately from the rotating shaft 44. The snow-collecting blade 45 is attached to an outer circumference of the snow-collecting rotating shaft 52. A snow-collecting driving gear 53 is provided to an outer circumference of one end portion of the snow-collecting rotating shaft 52.

Further, in this embodiment, the snow-collecting blades 45 are attached such that their rotating phases are different. Specifically, the snow-collecting blades 45 are attached such that their phases are shifted at 90° with respect to the rotating direction.

Further, a first gear 54 is attached to the end portion of the rotating shaft 44. On the outer circumferential side of the rotating shaft 44, a second rotating shaft 55 and a third rotating shaft 56 are rotatably supported by bearings 55*a* and 56*a*, respectively, the second rotating shaft 55 and the third rotating shaft 56 extending in parallel with the rotating shaft 44.

To an outer circumference of the second rotating shaft 55, a second driven gear 57 meshing with the first gear 54 and a second driving gear 58 are provided. The second driven gear 57 meshes with the first gear 54. A first speed reduction mechanism 59 is configured with those second rotating shaft 55, second driven gear 57, and second driving gear 58.

To an outer circumference of the third rotating shaft 56, a third driven gear 60 meshing with the second driving gear 58 and a third driving gear 61 are provided. The third driven gear 60 meshes with the second driving gear 58. A second speed reduction mechanism 62 is configured with those third rotating shaft 56, third driven gear 60, and third driving gear 61.

Further, the third driving gear 61 of the third rotating shaft 56 meshes with the snow-collecting driving gear 53 of the snow-collecting rotating shaft 52.

Accordingly, when the driving pulley 50 is driven and rotated via the driving belt 51 by driving the driving source 30, the rotating shaft 44 is driven and rotated. Further, the snow-throwing blade 46 attached to the rotating shaft 44 is driven and rotated by driving and rotation of the rotating shaft 44. In this case, the snow-throwing blade 46 is driven for forward rotation rotating in a direction in which the snow removal machine 1 moves.

Meanwhile, the snow-collecting rotating shaft 52 is driven and rotated via each of the second driven gear 57 meshing with the first gear 54 of the rotating shaft 44, the third driven gear 60 meshing with the second driving gear 58, and the snow-collecting driving gear 53 meshing with the third driving gear 61. This snow-collecting rotating shaft 52 is driven and rotated with respect to the rotating shaft 44 via the first speed reduction mechanism 59 and the second speed reduction mechanism 62 and is thus rotated in the opposite direction to the rotating direction of the snow-throwing blade 46.

Further, appropriately setting the number of teeth of each of the first gear 54, the second driven gear 57, the second driving gear 58, the third driven gear 60, the third driving gear 61, and the snow-collecting driving gear 53 makes it possible to arbitrarily set the reduction ratio of the snow-collecting driving gear 53 with respect to the rotational frequency of the first gear 54.

Here, in this embodiment, the reduction ratio is set to approximately 1:10, and in this configuration, the rotational speed of the snow-collecting rotating shaft 52 is reduced to approximately 1/10 with respect to the rotational speed of the rotating shaft 44.

Next, an action of this embodiment will be described.

First, when the driving pulley 50 is driven and rotated via the driving belt 51 by driving the driving source 30, the rotating shaft 44 is driven and rotated. Further, the snow-throwing blade 46 attached to the rotating shaft 44 is driven and rotated by driving and rotation of the rotating shaft 44. In this case, the snow-throwing blade 46 is driven for forward rotation rotating in the direction in which the snow removal machine 1 moves.

Meanwhile, the snow-collecting rotating shaft 52 is driven and rotated in the opposite direction to the rotating shaft 44 in response to driving and rotation of the rotating shaft 44 via each of the second driven gear 57 meshing with the first gear 54 of the rotating shaft 44, the third driven gear 60 meshing with the second driving gear 58, and the snow-collecting driving gear 53 meshing with the third driving gear 61, and the snow-collecting blade 45 is driven and rotated.

As described above, when the snow-collecting blades 45 are driven and rotated by rotating the snow-collecting rotating shafts 52, the snow present within the auger housing 41 is collected to the center by the snow-collecting blades 45, and the snow collected to the center by the snow-collecting blades 45 is discharged to the outside via the chuter 42 by driving and rotation of the snow-throwing blade 46. Accordingly, snow removal is performed.

In this case, the rotational speed of the snow-collecting rotating shaft 52 is reduced to approximately 1/10 with respect to the rotational speed of the rotating shaft 44. As described above, because the snow-collecting blades 45 rotate at a lower speed of approximately 1/10 with respect to the snow-throwing blade 46, when snow is collected by the snow-collecting blades 45, in a case where snow removal is performed in a whole width of the auger 43 or even in a case where snow removal is performed in approximately half a width of the auger housing 41, the speed of snow casted by the snow-collecting blades 45 is slow, and snow is thus not ejected to the outside of the auger housing 41. As a result, snow may efficiently be collected by the snow-collecting blades 45, and efficiency of snow removal work may be enhanced.

Further, because the snow-throwing blade 46 is driven for forward rotation rotating in a moving direction of the snow removal machine 1 and the snow-collecting blades 45 are driven and rotated in the opposite direction to the snow-throwing blade 46, the snow-collecting blades 45 easily bite into snow in collecting snow, and the reaction force lifting the vehicle body frame 10 of the snow removal machine 1 may thereby be suppressed. In particular, biting performance of the snow-collecting blades 45 into hard snow may be improved.

Further, because the two snow-collecting blades 45 are arranged while their rotating phases are shifted at 90°, vibration in the width direction occurs in the vehicle body frame 10 when the two snow-collecting blades 45 rotate, as a result a tip end of the auger housing 41 bites into snow, allowing smooth snow removal. Furthermore, because timings of snow collection by the snow-collecting blades 45 are shifted from each other, parts of snow collected by the snow-collecting blades 45 do not collide with each other, scattering of snow is thus prevented, and efficient snow removal may be achieved.

As described in the foregoing, in this embodiment, the snow removal machine 1 includes the driving source 30, the auger housing 41, the rotating shaft 44 to be driven and rotated by the driving source 30 within the auger housing 41, and the auger 43 arranged within the auger housing 41 and to be driven and rotated via the rotating shaft 44, the auger 43 includes the show-collecting blades 45 (snow-collecting units) located on both sides in the width direction of the auger 43 and collecting snow toward the center of the auger 43 in the width direction and the snow-throwing blade 46 (snow-throwing unit) located at the center of the auger 43 in the width direction, casting snow collected by the snow-collecting blades 45 by a centrifugal force, and discharging snow to the outside via the chuter 42, and the snow-collecting blades 45 are rotated at a lower speed than the snow-throwing blade 46.

Accordingly, because the snow-collecting blades 45 are rotated at a lower speed than the snow-throwing blade 46, when snow is collected by the snow-collecting blades 45, in a case where snow removal is performed in the whole width of the auger 43 or even in a case where snow removal is performed in approximately half the width of the auger housing 41, the speed of snow casted by the snow-collecting blades 45 is slow, and snow is thus not ejected to the outside of the auger housing 41. As a result, snow may efficiently be collected by the snow-collecting blades 45, and efficiency of snow removal work may be enhanced.

Further, in this embodiment, the snow-collecting blades 45 (snow-collecting units) on the both sides are rotated in different phases.

Accordingly, vibration in the width direction occurs in the vehicle body frame 10 when the two snow-collecting blades 45 rotate, as a result the tip end of the auger housing 41 bites into snow, allowing smooth snow removal. Furthermore, because timings of snow collection by the snow-collecting blades 45 are shifted from each other, parts of snow collected by the snow-collecting blades 45 do not collide with each other, scattering of snow is prevented, and efficient snow removal may be achieved.

Further, in this embodiment, the rotating shaft 44 receives the driving force from the driving source 30, is coupled with the snow-throwing blade 46 (snow-throwing unit), and includes the show-collecting rotating shaft 52 (sub rotating shaft) coupled with the snow-collecting blades 45 (snow-collecting units) and a speed reduction mechanism reducing the speed of the driving force of the rotating shaft 44 and transmitting the driving force to the snow-collecting rotating shaft 52.

Accordingly, because the rotating shaft 44 and the snow-collecting rotating shaft 52 may be driven and rotated by one driving source 30, energy saving and size reduction may be intended compared to a case where the snow-collecting blades 45 and the snow-throwing blade 46 are driven by separate driving sources 30.

Further, in this embodiment, the snow-collecting rotating shaft 52 (sub rotating shaft) is arranged outside and concentrically with the rotating shaft 44.

Accordingly, because the rotating shaft 44 and the snow-collecting rotating shaft 52 are concentrically arranged, space saving may be intended.

Further, in this embodiment, the snow-collecting blades 45 (snow-collecting units) and the snow-throwing blade 46 (snow-throwing unit) rotate in mutually opposite directions.

Accordingly, because the snow-throwing blade 46 and the snow-collecting blades 45 are driven and rotated in opposite directions, the snow-collecting blades 45 easily bite into snow in collecting snow, and the reaction force lifting the vehicle body frame 10 of the snow removal machine 1 may thereby be suppressed. In particular, biting performance of the snow-collecting blades 45 into hard snow may be improved.

Further, in this embodiment, the speed reduction mechanism includes the first speed reduction mechanism 59 connected with the rotating shaft 44 and the second speed reduction mechanism 62 connected with the first speed reduction mechanism 59, and the second speed reduction mechanism 62 is connected with the snow-collecting rotating shaft 52 (sub rotating shaft).

Accordingly, the first speed reduction mechanism 59 and the second speed reduction mechanism 62 are arranged between the rotating shaft 44 and the snow-collecting rotating shaft 52, and the snow-throwing blade 46 and the snow-collecting blades 45 may thereby be driven and rotated in opposite directions by a simple structure.

Further, in this embodiment, a rotational speed ratio between the snow-throwing blade 46 (snow-throwing unit) and the snow-collecting blades 45 (snow-collecting units) is approximately 10:1.

Accordingly, while snow collection by the snow-collecting blades 45 is performed at a low speed, the snow collected by the snow-collecting blades 45 may certainly be thrown by the snow-throwing blade 46.

Note that the present invention has been described based on the embodiment; however, the present invention is not limited to this embodiment. Because the embodiment merely represents one form for carrying out the present invention as an example, any modifications and applications are possible without departing from the scope of the gist of the present invention.

REFERENCE SIGNS LIST

1 snow removal machine
10 vehicle body frame
11 handle
20 traveling device
21 driving wheel
30 driving source

40 snow removal work unit
41 auger housing
42 chuter
43 auger
44 rotating shaft
45 snow-collecting blade
46 snow-throwing blade
47 rotating plate
48 snow-throwing plate
50 driving pulley
51 driving belt
52 snow-collecting rotating shaft
53 snow-collecting driving gear
54 first gear
55 second rotating shaft
56 third rotating shaft
57 second driven gear
58 second driving gear
59 first speed reduction mechanism
60 third driven gear
61 third driving gear
62 second speed reduction mechanism

The invention claimed is:

1. A snow removal machine comprising:

a driving source;

an auger housing;

a rotating shaft to be driven and rotated by the driving source within the auger housing; and an auger arranged within the auger housing and to be driven and rotated via the rotating shaft, wherein the auger includes:

two snow-collecting units, each of the two snow-collecting units being respectively located on opposite sides in a width direction of the auger, the two snow-collecting units each collecting snow toward a center of the auger in the width direction, wherein the width direction is an axial direction of the rotating shaft; and a snow-throwing unit located at the center of the auger in the width direction so as to be aligned along the rotating shaft with the two snow-collecting units, the snow-throwing unit casting snow collected by the two snow-collecting units by a centrifugal force and discharging snow to an outside via a chute, and wherein the rotating shaft receives a driving force from the driving source and is coupled with the snow-throwing unit, and the rotating shaft includes two sub rotating shafts and two speed reduction mechanisms, each of said two sub rotating shafts being coupled with an associated one of said two snow-collecting units, each of said two speed reduction mechanisms being coupled with an associated with one of said two sub rotating shafts and reducing a speed of the driving force of the rotating shaft and transmitting the driving force to the associated one of said two sub rotating shafts, whereby the two snow-collecting units are rotated at a lower speed than the snow-throwing unit, the two snow-collecting units are rotated in an opposite direction to a rotation direction of the snow-throwing unit, the two snow-collecting units are rotated in a same direction and in different phases from each other so that timings of snow collection by the two snow-collecting units are shifted from each other.

2. The snow removal machine according to claim 1, wherein the two sub rotating shafts are arranged outside and concentrically with the rotating shaft.

3. The snow removal machine according to claim 1, wherein each of the two speed reduction mechanisms includes a first speed reduction mechanism connected with the rotating shaft and a second speed reduction mechanism connected with the first speed reduction mechanism, and the second speed reduction mechanism is connected with the associated one of said two sub rotating shafts.

4. The snow removal machine according to claim 1, wherein a rotational speed ratio between the snow-throwing unit and the two snow-collecting units is approximately 10:1.

5. The snow removal machine according to claim 3, wherein the two sub rotating shafts are arranged outside and concentrically with the rotating shaft.

6. The snow removal machine according to claim 2, wherein a rotational speed ratio between the snow-throwing unit and the two snow-collecting units is approximately 10:1.

7. The snow removal machine according to claim 3, wherein a rotational speed ratio between the snow-throwing unit and the two snow-collecting units is approximately 10:1.

8. The snow removal machine according to claim 3, wherein the first speed reduction mechanism comprises:

a first gear is attached to the rotating shaft and, on an outer circumferential side of the rotating shaft, a second rotating shaft and a third rotating shaft are rotatably supported, the second rotating shaft and the third rotating shaft extending in parallel with the rotating shaft, and wherein a second driven gear meshing with the first gear and a second driving gear are provided to an outer circumference of the second rotating shaft, the first speed reduction mechanism is configured with the second rotating shaft, the second driven gear, and the second driving gear.

9. The snow removal machine according to claim 8, wherein the second speed reduction mechanism comprises:

a third driven gear meshing with the second driving gear and a third driving gear are provided to an outer circumference of the third rotating shaft, the second speed reduction mechanism is configured with the third rotating shaft, the third driven gear, and the third driving gear, the third driving gear of the third rotating shaft meshes with a snow-collecting driving gear provided to the associated one of said two sub rotating shafts.

* * * * *